US009366419B2

(12) United States Patent
Osborn

(10) Patent No.: US 9,366,419 B2
(45) Date of Patent: Jun. 14, 2016

(54) SELF-CONTAINED, PORTABLE UTILITY LIGHT AND METHOD

(71) Applicant: John Osborn, Gila, NM (US)

(72) Inventor: John Osborn, Gila, NM (US)

( * ) Notice: Subject to any disclaimer, the term of this patent is extended or adjusted under 35 U.S.C. 154(b) by 0 days.

(21) Appl. No.: 14/676,790

(22) Filed: Apr. 1, 2015

(65) Prior Publication Data

US 2015/0276188 A1 Oct. 1, 2015

Related U.S. Application Data

(60) Provisional application No. 61/973,395, filed on Apr. 1, 2014.

(51) Int. Cl.

| | |
|---|---|
| ***F21V 21/088*** | (2006.01) |
| ***F21V 21/22*** | (2006.01) |
| ***F21V 23/02*** | (2006.01) |
| ***F21L 4/04*** | (2006.01) |
| ***F21L 4/08*** | (2006.01) |
| *F21W 111/10* | (2006.01) |

(52) U.S. Cl.

CPC ..... *F21V 21/0885* (2013.01); *F21L 4/045* (2013.01); *F21L 4/085* (2013.01); *F21V 21/22* (2013.01); *F21V 23/023* (2013.01); *F21W 2111/10* (2013.01)

(58) Field of Classification Search

CPC ..... F21V 21/30; F21V 21/145; F21V 21/088; F21V 21/0832; F21V 21/0885; F21V 21/22; F21L 4/045; F21L 4/085; F21W 2111/10

USPC ..... 362/106, 191, 396, 105, 427, 103, 190, 362/287, 198, 200, 188, 203, 157

See application file for complete search history.

(56) References Cited

U.S. PATENT DOCUMENTS

| | | | |
|---|---|---|---|
| 1,744,777 | A | 1/1930 | Lundgren |
| 2,421,643 | A | 6/1947 | Ostli |
| 3,032,647 | A | 5/1962 | Wansky |
| 3,133,705 | A | 5/1964 | Eickelman |
| 4,186,429 | A | 1/1980 | Johnson |
| 4,406,040 | A | 9/1983 | Cannone |
| 4,533,984 | A | 8/1985 | Gatton |
| 4,631,644 | A | 12/1986 | Dannhauer |
| 4,665,568 | A | 5/1987 | Stutes |
| 4,827,384 | A | 5/1989 | Von Schlemmer |
| 4,991,068 | A | 2/1991 | Mickey |
| 5,463,538 | A | 10/1995 | Womack |
| 5,541,816 | A | 7/1996 | Miserendino |

(Continued)

*Primary Examiner* — Anh Mai
*Assistant Examiner* — Arman B Fallahkhair
(74) *Attorney, Agent, or Firm* — John D. Long, Esq.; Long & Chybik

(57) ABSTRACT

A self-contained, portable light assembly and method, the assembly generally comprising a housing body having a front body side and a back body side that are connected together by a top body end and bottom body end and further forming a hollow interior that contains a first power circuitry for energizing electrical light sources; a light panel pivotally attaches to the top body end and further supports one such electric light source, a telescopic mast that attaches to the housing body and supports another such electrical light source; a telescopic mounting device for supporting the housing body in a standalone and upright operating position, the telescopic mounting device telescopically supports a hook extension that has a C-shaped clip that can removably receive a brim of a hat in a secure manner that can allow the assembly to be removably mounted to the hat.

17 Claims, 7 Drawing Sheets

(56) References Cited

U.S. PATENT DOCUMENTS

| | | | | |
|---|---|---|---|---|
| 5,567,038 | A | 10/1996 | Lary et al. | |
| 5,667,292 | A | 9/1997 | Sabalvaro | |
| 5,676,449 | A | 10/1997 | Newsome | |
| 5,738,431 | A | 4/1998 | Lary | |
| 5,741,060 | A | 4/1998 | Johnson | |
| 5,911,494 | A | 6/1999 | Lary | |
| 6,056,413 | A | 5/2000 | Urso | |
| 6,206,543 | B1 | 3/2001 | Henry | |
| 6,467,929 | B2 * | 10/2002 | Lee | A42B 1/242 362/190 |
| 6,719,437 | B2 | 4/2004 | Lary et al. | |
| 6,764,194 | B1 | 7/2004 | Cooper | |
| D499,199 | S | 11/2004 | Cooper | |
| 7,017,871 | B2 * | 3/2006 | Chen | F04D 29/601 248/161 |
| 7,240,883 | B2 | 7/2007 | Liao | |
| 7,334,911 | B2 | 2/2008 | Sinegal | |
| 7,506,992 | B2 | 3/2009 | Carter | |
| 7,682,036 | B2 * | 3/2010 | Reiff | F21L 4/04 362/184 |
| 8,002,437 | B2 * | 8/2011 | Sohn | A42B 1/244 362/249.01 |
| 8,360,594 | B2 | 1/2013 | Sant | |
| 8,424,825 | B2 * | 4/2013 | Somuah | B60R 11/0235 248/130 |
| 8,783,892 | B2 * | 7/2014 | Liao | A42B 1/24 362/105 |
| 2005/0201085 | A1 * | 9/2005 | Aikawa | F21L 4/045 362/198 |
| 2008/0130272 | A1 * | 6/2008 | Waters | A42B 1/244 362/106 |
| 2009/0147505 | A1 * | 6/2009 | Robinett | H02J 7/35 362/183 |
| 2011/0210685 | A1 | 9/2011 | Liao | |
| 2013/0329412 | A1 * | 12/2013 | Ko | F21L 4/045 362/191 |

* cited by examiner

SELF-CONTAINED, PORTABLE UTILITY LIGHT AND METHOD

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to self-contained, portable utility lights that may be removably attached to hats. More specifically, the present invention may related to self-contained, portable utility lights that may removably attach to a brim or visor of a hat.

BACKGROUND

One of the more popular applications for battery-powered lights could be their permanent incorporation into a brim or visor of baseball-type caps of hats wherein the electrical light or illumination source can be located in the rim, top or bottom surfaces in the visor to generally project a light ahead of the cap or hat wearer. The batteries or other power sources and connecting circuitry could be also found in the visor or could otherwise be supported by other portions of the hat. In this manner, the cap wearer could have a full hands-free capability while having illumination provided in an otherwise darken environment that the wearer is present.

One possible limitation to such hat illumination hat devices is that the light assembly in being permanently attached or mounted to the cap generally cannot be otherwise attached to other structures (e.g., due to the possible attachment impediment caused by the overall hat structure) to provide illumination from different angles or heights other that the top of the wearer's head.

What could be needed therefore is an self-contained, portable utility light that while removably attachable to hat brim may have further attachment or support capabilities that may allow the self-contained, portable illumination source to attach or be supported by a wide variety of objects besides a hat brim when the self-contained, portable illumination source is not attached to the hat.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to substantially removably attach a self-contained portable light source to a cap brim or visor as well as to a variety of other objects;

provide a self-contained portable light source that may have a pivoting light panel that directs an electric light source away from a hat brim or visor;

the ability to substantially provide an additional strobe light at various heights from the housing of the self-contained, portable utility light;

provide a self-contained, portable utility light that may fold up into a compact storage state that has generally a rectangular form;

the ability to substantially adjust the telescopic mounting device to removably attach to brims and visors of various widths; and provide a self-contained, portable utility light has an adjustable telescopic mounting device that may allow the light source to be angled relative to a support for the light.

These and other advantages may be realized by reference to the remaining portions of the specification, drawings, claims, and abstract.

Brief Description of One Embodiment of the Present Invention

One possible embodiment of the invention could be a self-contained, portable light assembly comprising a housing body comprising a front body side and a back body side that are connected together by a top body end and bottom body end to denote a hollow interior; a light panel comprising a bottom panel edge that pivotally attaches to the top body end, the light panel further supporting one of one or more electric light sources; a first power circuit that energizes the one of one or more electrical light sources; a telescopic mast that attaches to the housing body, the telescopic mast supports another one of one or more electric light sources; a telescopic mounting device for supporting the housing body in a standalone operating position, the telescopic mounting device comprises a triangularly-shaped base section and a hook extension, the base section forming a first base end and a second base end, the second base end being wider that the first base end and pivotally attaches to the bottom body end, the first base end forming a channel aperture that leads to a receiving channel within the base section that movably receives the hook extension, the hook extension forming a C-shaped clip; wherein the C-shaped clip that can removably receive a brim of a hat in a manner that allows the invention to be securely mounted on top of the brim in a first standalone operating position.

Another possible embodiment of the invention could be a combination of a self-contained portable light assembly removably attached to and supported by a brim of a hat comprising a self-contained portable light assembly comprising a housing body formed from a front body side and a back body side that are connected together by a top body end and bottom body end and further forming a hollow interior, a light panel that pivotally attaches to the top body end and further supports one electric light source, a telescopic mast that supports another electrical light source and attaches to the housing body; a first power circuitry within the hollow interior for energizing at least the one electrical light source, a telescopic mounting device for supporting the housing body in a standalone operating position, the telescopic mounting device pivotally attaches to the bottom body end and telescopically supports hook extension that has a C-shaped clip that can removably receive a brim of a hat in a secure manner that can allow the invention to be mounted to the hat; a hat a brim, the brim having a leading edge; wherein the brim being removably accepted within the C-shaped clip supports the assembly on the brim.

Yet another possible embodiment of the invention could be a method of using self-contained, portable light assembly comprising of the following steps, but not necessarily in the order shown providing a self-contained portable light assembly comprising a housing body formed from a front body side and a back body side that are connected together by a top body end and bottom body end and further forming a hollow interior, a light panel that pivotally attaches to the top body end and further supports one electric light source, a telescopic mast that attaches to the housing body and supports another electrical light source; a first power circuitry located within the hollow interior for energizing at least the one electrical light source, a telescopic mounting device for supporting the housing body in a standalone operating position, the telescopic mounting device telescopically supports a hook extension that has a C-shaped clip, the C-shaped clip that removably receives a brim of a hat in a secure manner to allow the invention to be mounted to the hat; providing a hat with a brim, the brim having a leading edge; placing the telescopic mounting device into a first operating position wherein the telescopic mounting device is front of the front body panel and perpendicular to housing body; and inserting the leading edge into the C-shaped clip to locate the assembly upon the brim; adjusting the overall length of the telescopic mounting device to locate the housing body at a desired distance from the brim edge.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

Figure 1:
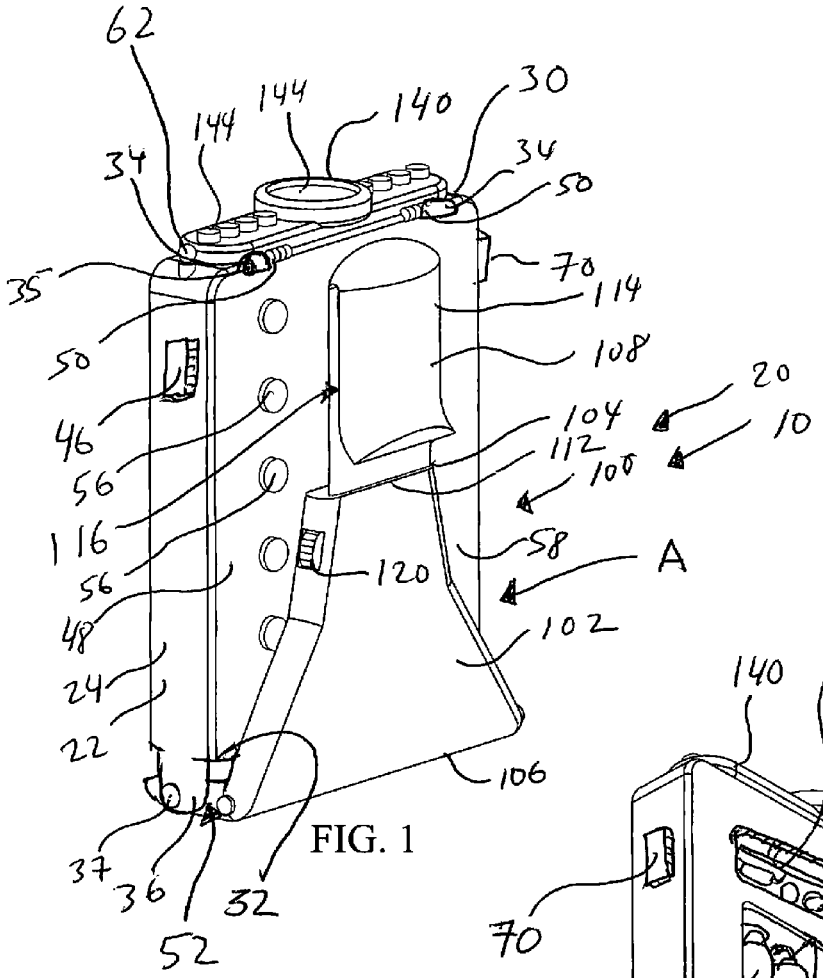
FIG. 1 is substantially a frontal perspective view of one embodiment of the portable utility light of the present invention in a folded compact state.
Figure 1A:
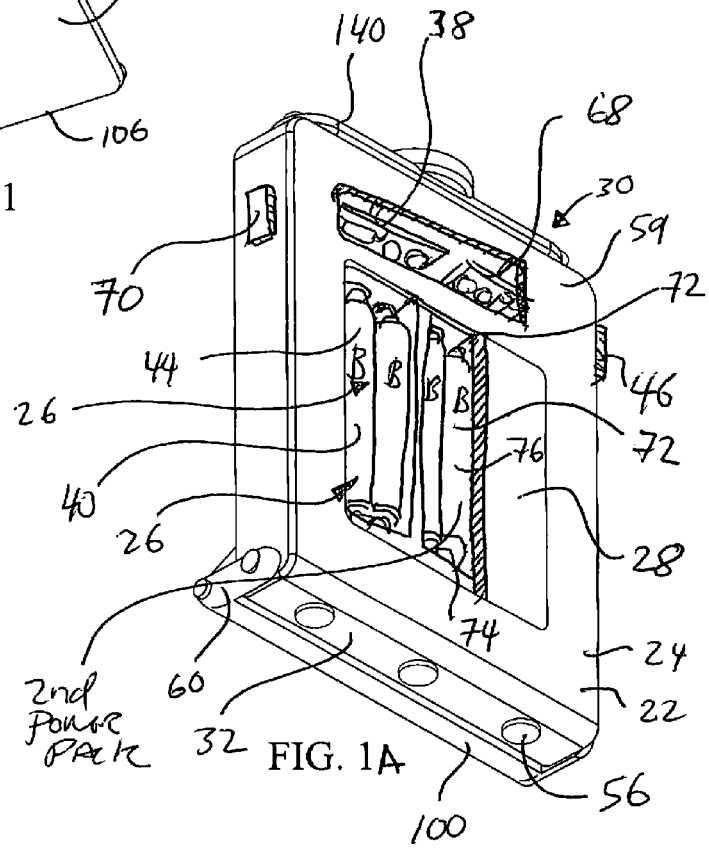
FIG. 1A is substantially a rear perspective cutaway view of one embodiment of the portable utility light of the present invention in a folded compact state.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

The present invention 10 could comprise a self-contained, portable utility light assembly 20 that can removably attach to a hat or cap 300 and a method or process for operating same 100. As substantially shown in FIGS. 1, 1A, 1B and 1C, the assembly 20 could comprise of a housing 22 having a housing body 24 with a top body end 30 and a bottom body end 32, the bottom body end 30 could pivotally connect to a telescopic mounting device 100 while the top body end 30 could pivotally connect to and support a light panel 140. In one possible embodiment, the housing body 24 could be constructed or formed from a suitable polymer such as styrene plastic, the housing body 24 could further denoting a hollow interior 26 that could be accessed by a hatch 28 removably attached to the back body side 59 of the housing body 24.

The hollow interior 26 could support at last a portion of a first powering circuitry 38 that in one possible embodiment could energize a panel light source(s) 144 of the light panel 140. The first powering circuitry 38 could comprise a first on/off illumination switch 46, a first power source 40 (e.g. a first battery box 42 with appropriate number of first batteries 44) and suitable wiring for connecting such components together in a circuit to generally provide power to the panel light source 144 as supported by the light panel 140. In at least one embodiment, a solar panel 160 could be supported by the housing body 24 or the hatch 28 as a way of recharging the first power source 40 of the first powering circuitry 38.

In one possible embodiment, an exterior 48 of the housing body 24 could substantially form a rectangular shape generally denoting the top body end 30 and the bottom body end 32. At each end of the top body end 30 could be respective mounting nib 34 while at each end of the bottom body end 32 could be a respective mounting tip 36. A distal or bottom panel edge 152 of the light panel 140 could be movably located between and connected to the pair of mounting nibs 34 wherein a suitable pin 35 could pass through the respective mounting nib 34 to connect to the bottom panel edge 152 to form the light panel pivoting connection points 50 between the housing body 24 and the light panel 140. As substantially shown in FIG. 1B, another embodiment of the invention 10 could have the mounting nibs 34 could be replaced by panel hinges 54 that pivotally connect the light panel 140 to the top body end 30. A second base end 106 of the telescopic mounting device 100 could be movably located between the pair of mounting tips 36 wherein a suitable rod 37 could pass through a respective mounting tip 46 and connect to the second base end 106 to form the clip pivoting connection points 52 between the housing body 28 and the telescopic mounting device 100. In another embodiment, as substantially shown in FIG. 1A, the mounting tips 36 could be clip hinges 60 that are movably attached by sets of rods passing through the clip hinge's ends to the bottom body end 32 and to the second base end 106. The clip hinges 60 could provide sufficient articulated movement to the telescopic mounting device 100 to allow the telescopic mounting device 100 to lie flat against the front side 58 of the housing body 24 in the compact storage position A (see FIG. 1.) The telescopic mounting device 100 could be lowered to be still be located in front of or on the same side as the front body side 58 and to be perpendicular to the front body side 58 to allow the C-shape clip 114 to generally attach to a hat brim in a first operating position B (see FIG. 2.) The telescopic mounting device 100 could be further rotated about 180° degrees from the front of the housing body 24 (e.g., from the first operation position B) to the back of the housing body wherein the telescopic mounting device 100 could be proximate and perpendicular to the back body side 59 to a second operating position C to generally allow the telescopic mounting device 100 to rest upon a non-hat vertical support surface such as a table top (see FIG. 3.)

In at least one embodiment, the housing's body's front side 58 could further support one or more body light sources 56 (e.g., electrical light sources such as incandescent bulbs, LEDs (Light Emitting Diode] and the like light sources) that could also be electrically connected to a first powering circuitry 38. Additionally, the bottom body end 32 could further support yet additional body light sources 56 that could also be electrically connected to the first powering circuitry 38.

Figure 1B:
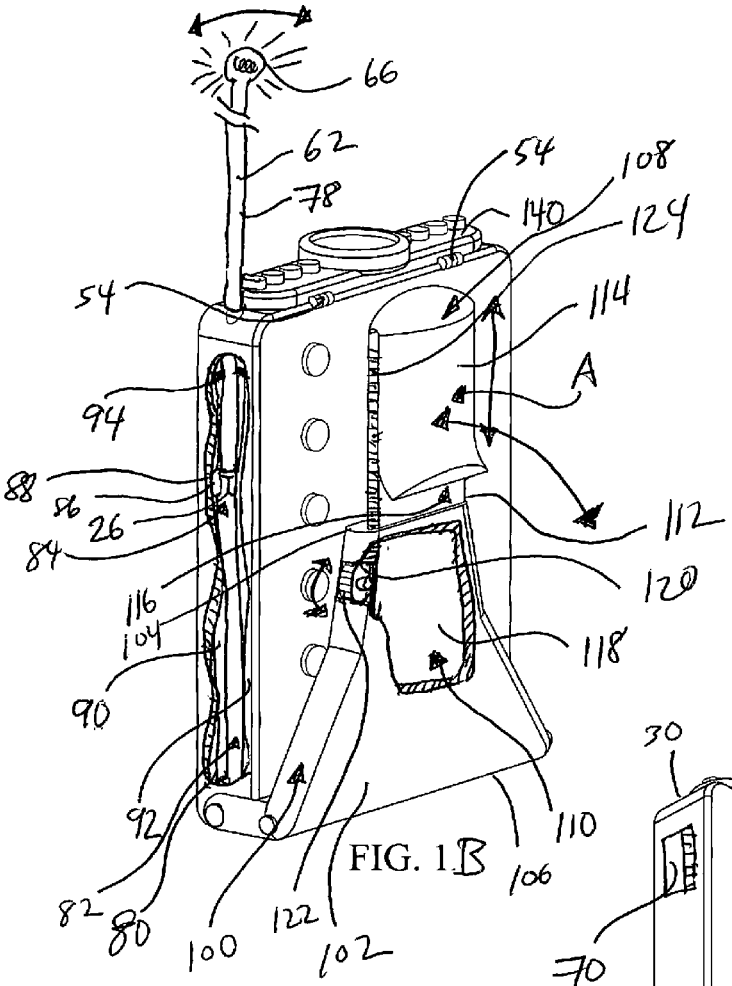
FIG. 1B is substantially a frontal perspective cutaway view of one embodiment of the portable utility light of the present invention in a folded compact state showing an extended top segment.
Figure 1C:
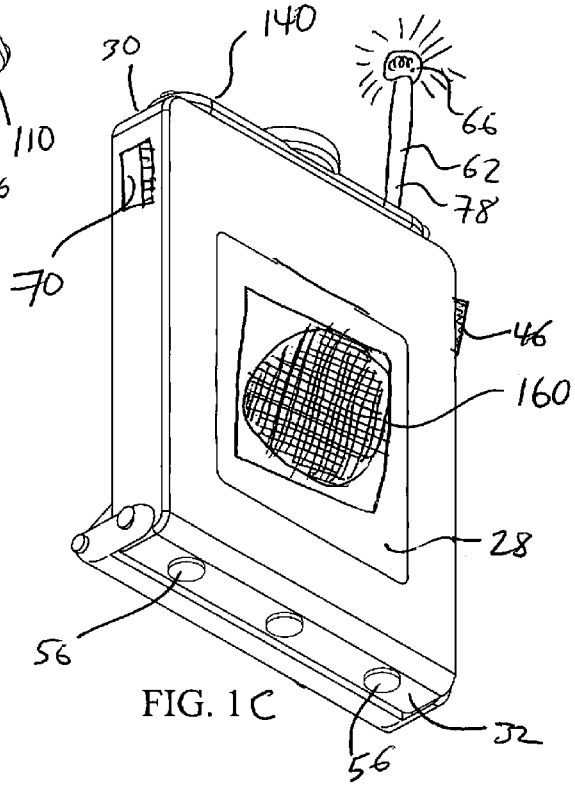
FIG. 1C is substantially a rear perspective view of another embodiment of the portable utility light of the present invention in a folded compact state.
Figure 2:
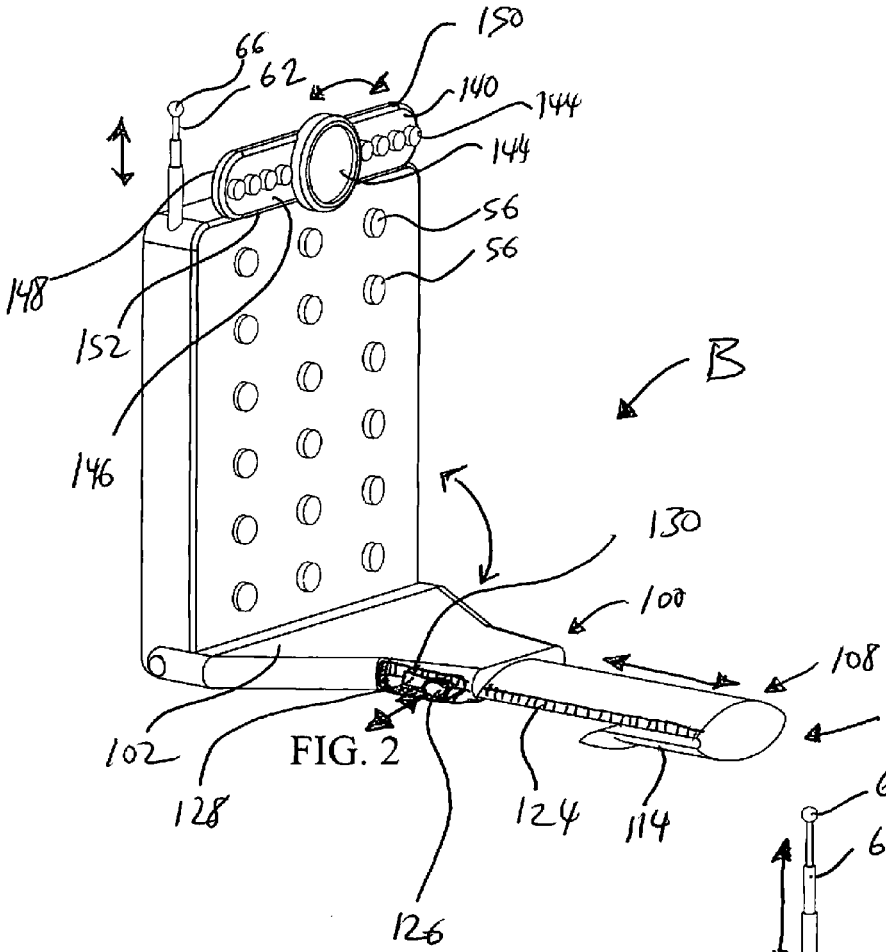
FIG. 2 is substantially a frontal perspective cutaway view of one embodiment of the portable utility light of the present invention in a extend state for engaging a hat brim.
Figure 3:
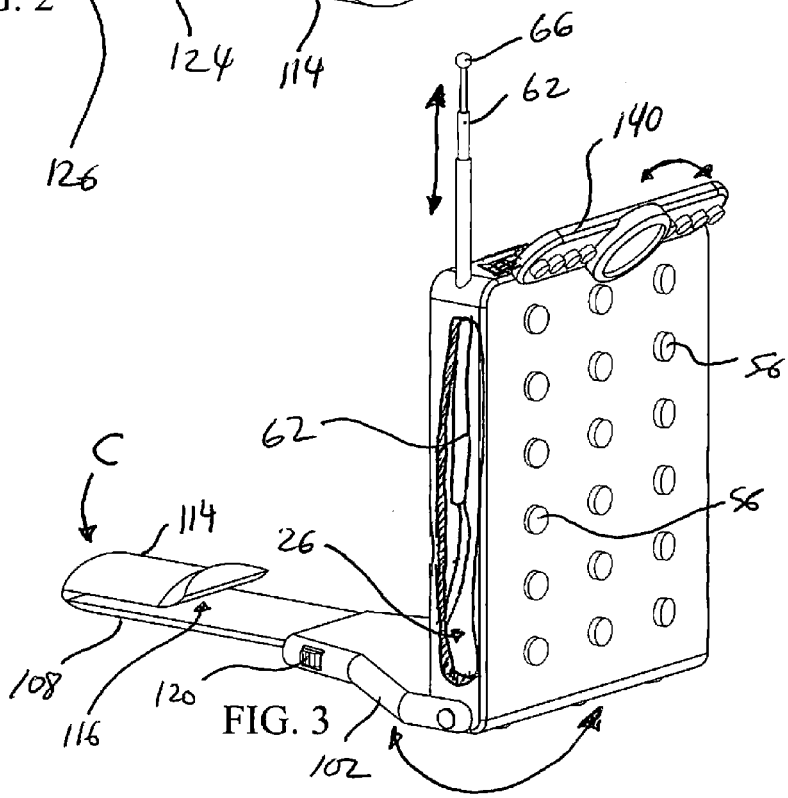
FIG. 3 is substantially a frontal perspective cutaway view of one embodiment of the portable utility light of the present invention in an extended state for resting upon a horizontal surface other than a hat brim.
Figure 4:
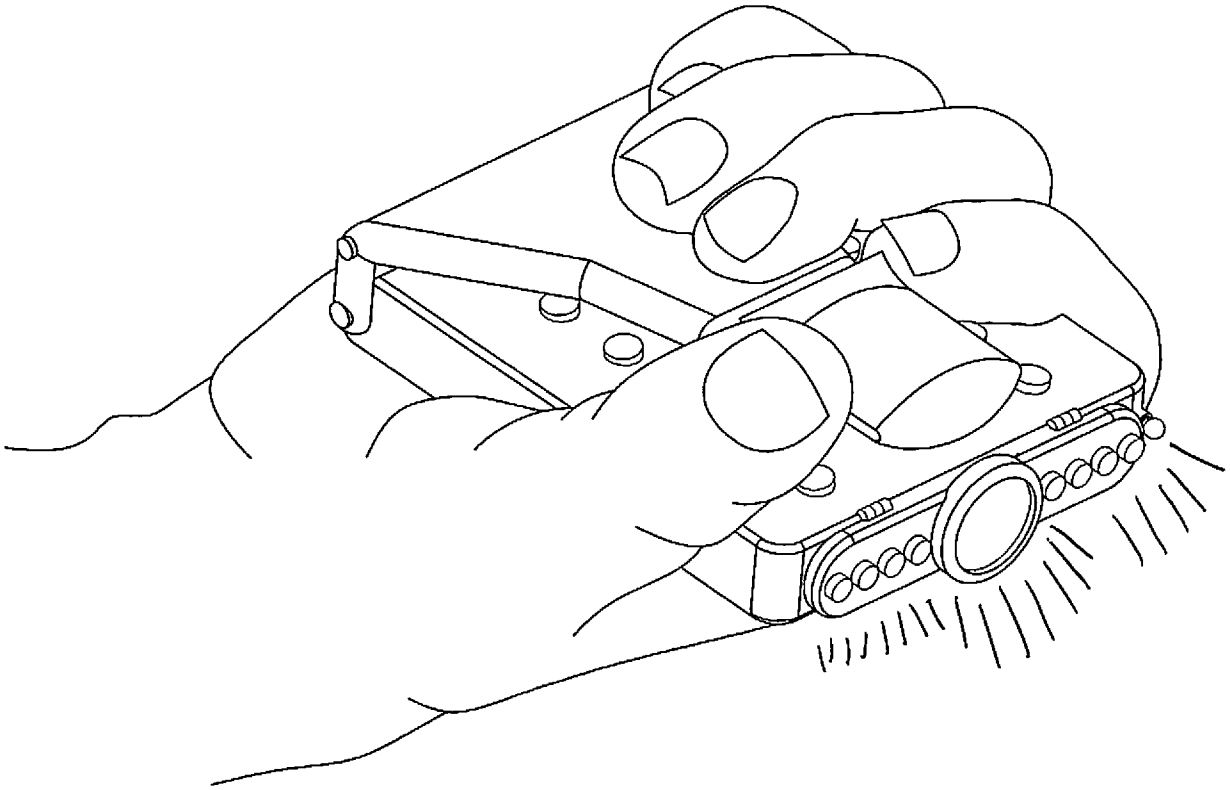
FIG. 4 is substantially a frontal perspective cutaway view of one embodiment of the portable utility light of the present invention in a folded compact state being hand supported.
Figure 5:
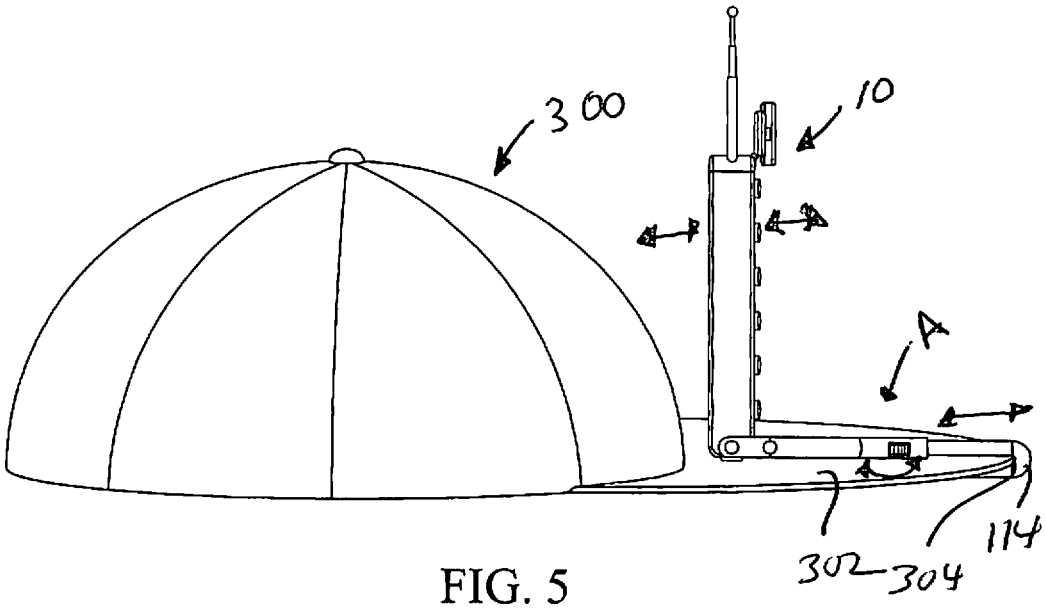
FIG. 5 is substantially a side elevation view of one embodiment of the portable utility light of the present invention as being attached to a hat brim.
Figure 6:
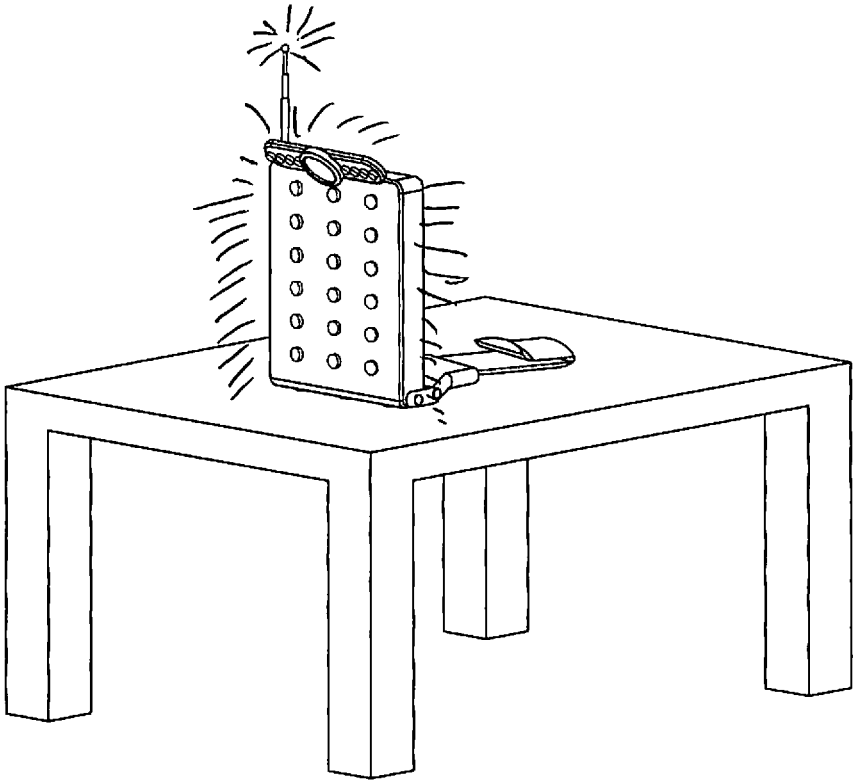
FIG. 6 is substantially a frontal perspective cutaway view of one embodiment of the portable utility light of the present invention being supported by a horizontal surface of a table.
Figure 6A:
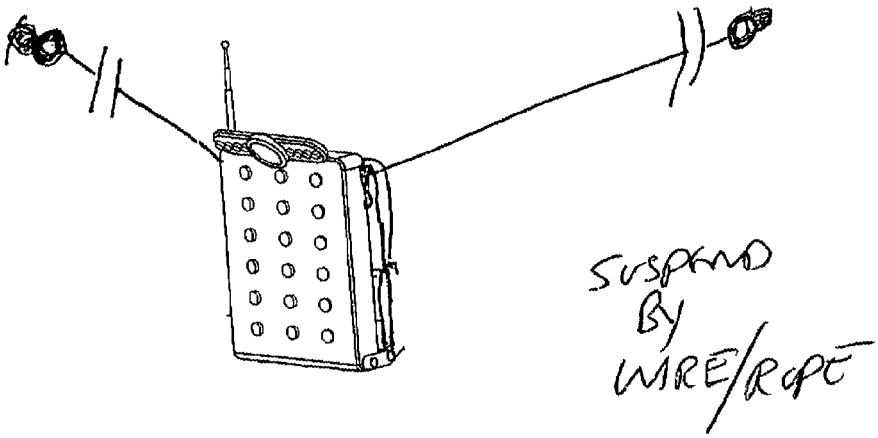
FIG. 6A is substantially a frontal perspective view of one embodiment of the portable utility light of the present invention in a folded compact state showing the light being suspended by a wire.
Figure 7:
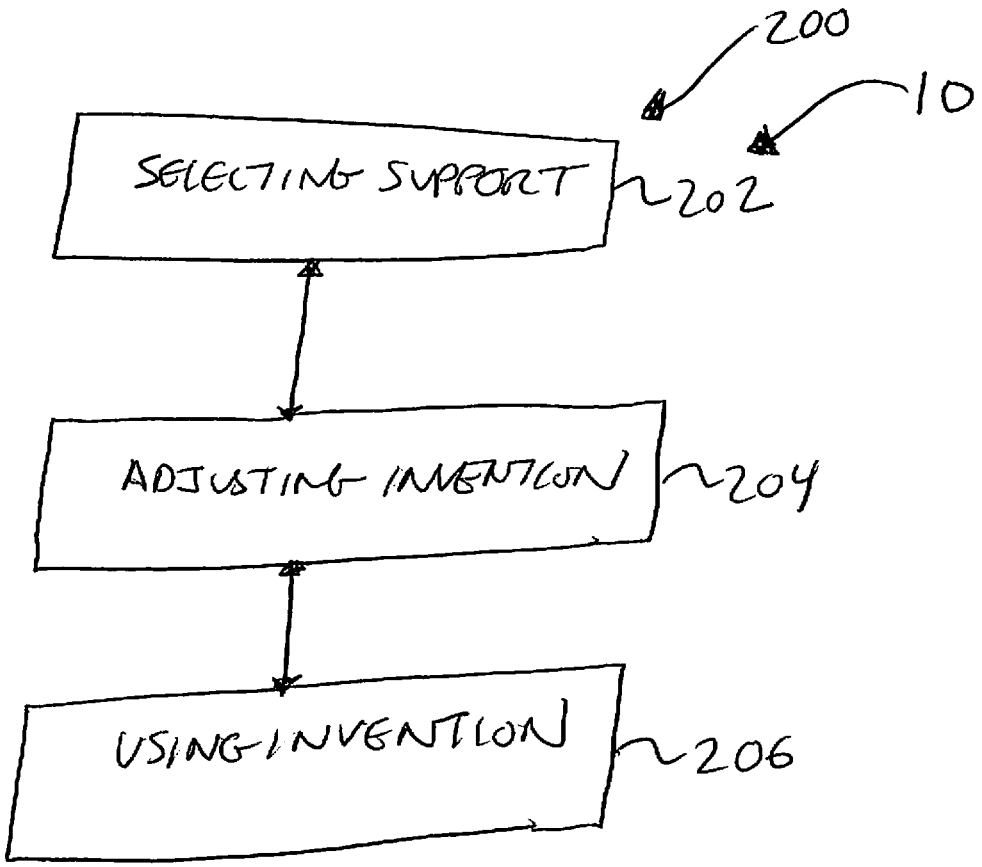
FIG. 7 is substantially a flowchart schematic showing one possible embodiment of a process or method for operating the present invention.

In at least one embodiment, as substantially shown in FIGS. 1B, 1C and 3, the housing body 24 could further comprise and support a telescopic mast 62 that at one free end supports an mast light source 66 (e.g., an electrical light source such as an incandescent bulb, LED, and the like) that may be distinct from the panel light sources 144 and body light sources 56 in power and in operation. The mast light source 66 could function to substantially provide an location or emergency signaling to others rather than provide an illuminating of an object to be made to be seen easier by the operator in a darken environment. The telescopic mast 62 could have nestled telescopic segments, the telescopic mast 62 being generally secured by the telescopic mast's base end to the top body end 30. In the collapsed state, the nestled telescopic segments could be generally be accommodated within the housing body interior 26.

In one possible embodiment, the mast end illumination source 64 could be electrically connected (e.g., by wires running in a hollow mast interior) not to the first powered circuity 38 but to a separate second powered circuitry 68 that could also be accommodated in the housing body's hollow interior 26. (See FIG. 1A.) The second power circuitry 68 could have a suitable strobe capability (e.g., a flip-flop electrical circuit-not-that is not shown) to substantially provide for a blinking or strobe lighting effect rather than a constant illumination. A body mounted second light switch 70 that is substantially separate from the first light switch 46 could electrically connect a second power source 72 (e.g., a second battery pack 74 containing second battery[ies] 76) to the mast light source 66. In at least one embodiment, the mast light source could provide a red colored illumination.

In at least another embodiment, the telescopic mast 62 could comprise of a hollow top mast segment tube 78 generally removably received within an hollow tube interior 82 of a bottom mast segment tube 80. The top segment hollow tube 78 could be made of a non-conductive material (e.g. a polymer, such as styrene plastic) that generally supports at a first end a mast light source 66. The mast light source 66 could be connected by mast wires passing through the top mast segment tube's hollow interior 84 to electrical contacts 86 as supported by an exterior of the top segment's second top end 88 (generally having a ball shape.) (See FIG. 1B.)

The bottom segment hollow tube 80 could also be made of a non-conductive material (e.g. a polymer, such as styrene plastic) and along the length of the bottom tube interior 82 feature two metallic strips, a negative strip 90 and a positive strip 92 placed apart from one another in parallel longitudinal orientation. The metallic strips 90 and 92 could be respectively electrically connected to the remaining second powered circuitry 68. The electrical contacts 86 could movable connect to respective metallic strips 90, 92 to movably and electrically connect the mast light source 66 to the secondary power circuitry 68. As the top mast segment tube 78 moves relative to the bottom mast segment 80, the mast light source 66 could have constant yet movable electrical connection with the second powered circuitry 68. The bottom mast segment tube 80 at the first bottom open end 94 could be crimped or tapered inwards to generally retain the ball-shaped second end 88 within the bottom interior 82 while at the same time allowing the top mast segment tube 78 generally having a non-parallel relationship with the bottom mast segment tube 80 (with the telescopic mast 62 fully extended, the top mast segment tube 78 could be placed in a bent or canted orientation to the bottom mast segment tube 80 as well as the housing body 24.)

The telescopic mounting device 100 in one possible embodiment could comprise of generally triangular shaped base section 102 that has a narrow first base end 104 that may movable accepts a hook extension 108 and a has a wide second base end 106 that may pivotally attach to the bottom body end 32 of the housing body 24. The base section 102 could be made of a suitable resilient material such as a polymer like styrene plastic to generally form a channel aperture 112 that generally connects to a receiving channel 110 could movably accept the hook-shaped extension 108. The hook-shaped extension 108 could comprise of a C-shaped spring or clip 110 attached to an end of an extension plate 118. A remaining extension end could be movably received through the channel aperture 112 and within the receiving channel 110 to provide the telescopic mounting device 100 with an adjustment means to adjust the telescopic mounting device's overall length to appropriately fit to a width of the visor or brim 202 of a hat 200 to which the invention 10 is being applied.

The base section 102, in one embodiment as substantially shown in FIGS. 1, 1B, 3, and 5 to substantially accommodate a width variety of hat brims 302 having different widths, could movably support an offset mounted wheel 120 whose knurled edge 122 could engage a serrated edge 124 of the extension plate 118. The operator could substantially rotate the offset mounted wheel 120 to generally move the hook extension 108 in or out of the receiving channel 110 to adjust (e.g., increase or decrease) the telescopic mounting device's overall length as between the hook shaped clip 114 and the wide second base end 106. In another embodiment as substantially shown in FIG. 2, the base section 102 could movably support a spring biased button 106 on the telescopic body's surface, the button 106 could be connected to and move a lever 128, the lever at one lever end could support a pawl 130, to generally allow the pawl 130 to engage or disengage a serrated (or tooth edge) edge 124 of the extension plate 118 to allow the hook extension 108 to be move in or out of the base section 102 (again to accommodate various hat brims 302 having different widths) by hand.

The light panel 150 could feature a rectangular panel body 142 that could support one or more panel light sources 144. The panel light source 144 could be selected from a variety of electrical illumination means, such as incandescent bulb, LED or the like. The panel body 142 could have a front panel side 146 and a rear panel side 148 generally connected together by a top panel edge 150 and a bottom panel edge 152. In one embodiment, the front panel side 146 could have several panel light sources 144 arranged in tandem along the length of the front panel side 146. The hinged or other movable attachment of the panel body 142 to the housing body 24 could allow the panel body 142 to be canted relative to the housing body 24 to adjust the angle of an illumination of the panel light source 144.

Process

A substantially shown in FIGS. 4, 5, 6, 6A and 7, one possible process or method 200 for operating the invention could start with step 202, selecting the support for the invention. In step, the operator could determine what kind environment the operator is in to operate the invention: e.g., a moving and hands free darken environment requiring the light to be attached to the operator; a moving and hands occupied darken environment requiring the operator to hold the invention; a non-moving and hands free darken environment requiring the invention to be supported in a manner besides the operator, such a table, support were or rope, and the like. Once this step is substantially completed, the process 200 can proceed to step 204 adjusting the invention for its support.

In step 204, adjusting the invention for its support, the operator can manipulate the telescopic mounting device as needed, generally starting with the invention being in the compact storage state. For use on a table, the operator can bring the invention out of its compact carry state or position A by pivoting away the telescopic mounting device away from the housing body's front side until the telescopic mounting device is generally located on the same side as and perpendicular to the back body side of the housing body (e.g., operating position C.) In this manner, the C-clip could be located up and away from the side of the telescopic mounting device portion that will contact the horizontal support surface (e.g., top of the table.) The telescopic mounting device can then be set down upon a horizontal and planar surface such as a top of table.

For use on a suspended rope or pocket of the operator's articles of clothing, the invention can be keep in the compact storage position A. The C clip is brought up and over the wire/rope or pocket edge and then suitably secured to the wire/rope or pocket.

For use on a hat with a brim (e.g., a baseball cap with a visor), the operator can bring the invention out of its compact carry state by pivoting away the telescopic mounting device away from the housing body's front side (e.g., compact storage position) until the telescopic mounting device still generally located proximate and but perpendicular to the front side of the housing body (operating position B.) In this manner, the C-clip is located on the underside of the telescopic mounting device to contact the brim or visor. The operator by activating the offset wheel, button or alike can adjust the overall length of the telescopic mounting device to meet the width of the visor or brim so the housing body could be located proximate the head covering portion of the hat and distal from the outer edge of the visor or brim. The operator then could engage and slip the outer edge of the visor into the C-shaped clip to attach the invention onto the hat.

For hand carrying, the invention could be kept in the compact storage state and could be suitable grasped by the operator and pointed in the desired direction.

As this step is substantially completed, the process 200 could proceed to step 206, using the invention.

In step 206, using the invention, the operator could decide which illumination sources to use and then activate the selected one(s). For the light panel, the operator could activate it through the appropriate light switch and then move (e.g., tilt) the energized light panel as needed for point the emitted light towards an area of use. In that the body illumination sources could also be activated by this switch as well, the body positioning of the invention could be adjusted by the operator to direct the energized body illumination sources towards an area of interest. If the mast illumination or lighting is desired, the second light switch could be used to energize the mast light source (which for an emergency embodiment could be project a red light, strobing light or both). The telescopic mast could be extended to a desired height above the housing body. In certain embodiments, the telescopic mast upon further extension could be canted away from the housing body and pointed in a direction as desired. After the operator is finished using the invention 10, the process 200 could be reversed to place the invention 10 back into a compact storage position or state.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As described above and shown in the figures, the present invention provides a wide selection of position adjustable electric illumination source for a self-contained portal utility light. The invention provides for a hinged support base that can be moved between compact position A, folded flat against gained the front side of the housing body to operating position B in front of and perpendicular to the housing body (for attachment to a hat) to being perpendicular to and on the back side of the housing body for resting upon a table or like. The Invention further features a cantable telescopic mast for generally mounting a flashing warning or help wanted light. In this manner, the invention could provide an illumination means that can be attached to a wide variety of support means.

What is claimed is:

1. A self-contained, portable light assembly comprising:

(A) a housing body comprising a front body side and a back body side that are connected together by a top body end and bottom body end to denote a hollow interior;

(B) a light panel comprising a bottom panel edge that pivotally attaches to the top body end, the light panel further supporting one of one or more electric light sources;

(C) a first power source that energizes the one of one or more electrical light sources;

(D) a telescopic mast that attaches to the housing body, the telescopic mast supports another one of one or more electric light sources;

(E) a telescopic mounting device for supporting the housing body in a standalone operating position, the telescopic mounting device comprises a triangularly-shaped base section and a hook extension, the base section forming a first base end and a second base end, the second base end being wider that the first base end and pivotally attaches to the bottom body end to initially position the telescopic mounting device to lie against the housing body in a parallel orientation, the first base end forming a channel aperture that leads to a receiving channel within the base section that movably receives the hook extension, the hook extension forming a C-shaped clip;

wherein the C-shaped clip removably receives a brim of a hat in a manner that allows the light assembly to be securely mounted on top of the brim in to have the housing body pivot about the bottom body end into an upright position perpendicular to telescopic mounting device, proximate to a head covering portion of the hat and distal from an outer edge of the brim.

2. The assembly of claim 1 wherein the another one of one or more electric light sources is energized by a second power source that is separate from the first power source.

3. The assembly of claim 2 wherein the second and separate power source is contained with the hollow interior.

4. The assembly of claim 2 wherein the second power source energizes the another one of one or more electric light sources to emit a flashing light.

5. The assembly of claim 1 wherein the telescopic mounting device can move from a first operating position that is on the same side of the front body panel and is perpendicular to the front body panel to a second operating position that is on the same side of the back body panel and perpendicular to the back body panel.

6. The assembly of claim 5 wherein the second operating position places the C-shaped clip in a location that prevents the C-shaped clip from removably receiving the hat brim.

7. The assembly of claim 1 wherein a portion of the telescopic mast supporting the another one of one or more electric light sources can cant away from the housing body.

8. The assembly of claim 1 wherein a solar panel mounted to the housing body can recharge a first power source of the first powering circuitry.

9. The assembly of claim 1 wherein the light panel rotates down upon and parallel to the top body end and the telescopic mounting device folds up against the front body side to form a compact storage position for the light assembly in a manner that allows the one of one or more electric light sources to face away from the top body end.

10. The assembly of claim 1 wherein an exterior of the housing body supports a yet another one of one or more electric light sources.

11. The assembly of claim 1 wherein the second base section movably mounts in an offset manner via a knurled wheel that engages a serrated edge of the hook extension to adjust an overall length of the telescopic mounting device.

12. A combination of a self-contained portable light assembly removably attached to and supported by a brim of a hat comprising:

(A) a self-contained portable light assembly comprising a housing body formed from a front body side and a back body side that are connected together by a top body end and bottom body end and further forming a hollow interior, a light panel that pivotally attaches to the top body end and further supports one electric light source, a telescopic mast that supports another electrical light source and attaches to the housing body; a first power circuitry within the hollow interior for energizing at least the one electrical light source, a telescopic mounting device for supporting the housing body in a standalone operating position, the telescopic mounting device pivotally attaches to the bottom body end to initially lay flat against housing body in a parallel orientation and telescopically supports a hook extension that has a C-shaped clip that can removably receive a brim of a hat in a secure manner that can allow the light assembly to be mounted to the hat;

(B) a hat a brim, the brim having a leading edge;

wherein the brim being removably accepted within the C-shaped clip supports the assembly on the brim in manner to allow the housing body to be pivoted about the bottom body end that is distal from brim into an upright position perpendicular to the telescopic mounting device, proximate to a head covering portion of the hat and distal from the leading edge.

13. The combination of claim 12 wherein the telescopic mounting device is adjustable in length to locate the housing body at a desired distance away from the leading edge.

14. A method of using self-contained, portable light assembly comprising of the following steps, but not necessarily in the order shown:

(A) providing a self-contained portable light assembly comprising a housing body formed from a front body side and a back body side that are connected together by a top body end and bottom body end and further forming a hollow interior, a light panel that pivotally attaches to the top body end and further supports one electric light source, a telescopic mast that attaches to the housing body and supports another electrical light source; a first power source located within the hollow interior for energizing at least the one electrical light source, a telescopic mounting device for supporting the housing body in a standalone operating position, the telescopic mounting device telescopically supports a hook extension that has a C-shaped clip, the C-shaped clip that removably receives a brim of a hat in a secure manner to allow the invention to be mounted to the hat;

(B) providing a hat with a brim, the brim having a leading edge;

(C) placing the telescopic mounting device into a first operating position wherein the telescopic mounting device is front of the front body panel and perpendicular to housing body;

(D) inserting the leading edge into the C-shaped clip to locate the assembly upon the brim;

(E) adjusting the overall length of the telescopic mounting device to locate the housing body at a desired distance from the brim edge; and (F) pivoting the housing body about the bottom body end into an upright position perpendicular to the telescopic mounting body and brim, proximate to a head covering portion of the hat and distal from the leading edge.

15. The method of claim 14 further comprising a step of extending the telescopic mast to its full length and canting it in orientation to the housing body.

16. The method of claim 14 further comprising a step of energizing the one electric light source energized by the first power source and another step of energizing the another electric light source energized by a second power source that is different from the first power source, the one electric light source and the another electric light source being supported by an exterior of the housing body.

17. The method of claim 14 wherein step of energizing further comprises a step of causing the another light source to emit a flashing red light.

* * * * *